US005895082A

United States Patent [19]

Kaluzny

[11] Patent Number: 5,895,082

[45] Date of Patent: Apr. 20, 1999

[54] MANUAL PICK UP DEVICE

[76] Inventor: William Kaluzny, 835 McIvor Street, Winnipeg, Manitoba, Canada, R2G 2K1

[21] Appl. No.: 08/917,560

[22] Filed: Aug. 26, 1997

Related U.S. Application Data

[63] Continuation-in-part of application No. 08/695,592, Aug. 12, 1996, abandoned.

[51] Int. Cl.[6] ..... A01K 29/00; E01H 1/12

[52] U.S. Cl. ..... 294/1.4; 294/19.1

[58] Field of Search ..... 294/1.3–1.5, 11, 294/19.1, 19.2, 22–24, 50.8, 50.9, 57, 115; 15/257.6, 257.7

[56] References Cited

U.S. PATENT DOCUMENTS

| | | | |
|---|---|---|---|
| 1,572,426 | 2/1926 | Foote | 294/19.1 X |
| 2,803,484 | 8/1957 | Puckett | 294/19.1 X |
| 2,891,811 | 6/1959 | Strickler | 294/50.9 X |
| 2,902,815 | 9/1959 | Gallo | 294/50.8 X |
| 3,328,066 | 6/1967 | Johnston | 294/1.4 X |
| 3,785,689 | 1/1974 | Tanksley | 294/19.1 |
| 4,039,216 | 8/1977 | Soos | 294/19.1 |
| 4,225,174 | 9/1980 | Hennessy et al. | 294/1.4 |
| 4,231,603 | 11/1980 | van Zelm | 294/19.1 |
| 4,629,234 | 12/1986 | Sokolowski | 294/19.1 |
| 4,669,769 | 6/1987 | Polder | 294/19.1 |
| 4,715,632 | 12/1987 | McVey | 294/19.2 X |
| 5,380,054 | 1/1995 | Galvis | 294/1.4 |

FOREIGN PATENT DOCUMENTS

| | | | |
|---|---|---|---|
| 1051563 | 1/1954 | France | 294/22 |
| 539531 | 9/1941 | United Kingdom | 294/19.1 |

*Primary Examiner*—Johnny D. Cherry
*Attorney, Agent, or Firm*—Adrian D. Battison; Murray E. Thrift

[57] ABSTRACT

The present invention provides a manually operated pick-up device particularly of the type for picking up items outside of normal reach. The manual pick-up device comprises a shaft, pick-up blades mounted at a bottom end of the shaft, a handle grip mounted at a top end of the shaft, and an actuator mounted on the handle grip. The pick-up blades are mounted at an angle to the shaft such that with the shaft angled downwards the contact edges of the blades lie in a substantially horizontal plane. Actuating the actuator causes the pick-up blades to move between an open position and a closed position causing the pick-up blades to pick up an item.

18 Claims, 12 Drawing Sheets

MANUAL PICK UP DEVICE

CROSS REFERENCE TO RELATED APPLICATIONS

This application is a continuation-in-part of application Ser. No. 08/695,592 filed Aug. 12, 1996 now abandoned.

FIELD OF THE INVENTION

The present invention provides an improved manually operated pick-up device particularly of the type for picking up items outside of normal reach.

BACKGROUND

Picking up an article which is lying on the ground usually requires that an individual bend over or squat down to bring the item within reach so that it can be picked up. If this has to be done repeatedly, it can lead to fatigue or injury. This task can also be unpleasant if the item to be picked up is of an unpleasant nature since it brings the face of the individual into close proximity with the item. This is particularly the case when cleaning up animal excrement such as that left behind by a pet.

Many prior pick-up devices are known which have been developed to enable an individual to reach an item on the ground from a standing position. These devices generally have some pick-up means fixed at the end of a long shaft and a handle at the top of the shaft which has actuating means which cause the pick-up means at the bottom of the shaft to pick up the desired items. The pick-up means often have fingers or scoops for picking up items.

Devices of this type having fingers work well for hard solid items but do not work well with soft items since the fingers can pinch or sever the item as it is being picked up. Pick-up devices with scoops can pick-up soft items but have the problem that they are usually fixed to the shaft of the device such that the bottom edge of the scoops lie perpendicular to the shaft of the device. This requires an individual using the device to stand above or directly to the side of the item to be picked up. If this is not done, the bottom edges of the scooping blades are at an angle to the item to be picked up making it difficult or impossible to pick the item up.

The fingers or scoops of these devices are also generally not readily removable from the device making cleaning of the fingers or scoops and storage of the device more difficult.

Another problem of existing pick-up devices is that they are not self supporting such that the shaft of the device remains upright when the fingers or scoops of the device are positioned to support the device on a surface. This can be inconvenient if an individual using the pick-up device wishes to temporarily rest the pick-up device on the ground or other surface to perform a different task before continuing with use of the pick-up device since the device will tend to fall over requiring that the user bend over and pick it up.

SUMMARY

According to the present invention there is provided a manual pick-up device comprising:

a shaft having a first end and a second end;

pick-up means mounted on the shaft at the second end thereof said pick-up means including:

a pincer mechanism fixed to the second end of the shaft comprising a pair of laterally spaced apart pivot mounts and a pair of pincer members, each pincer member having a first end and a second end and being mounted at the first end on a respective one of the pivot mounts and extending outwards therefrom to the second end, said pincer members being arranged to lie substantially in a plane extending through the shaft and the pivot mounts and being free to pivot in the plane extending through the shaft and the pivot mounts between an open position with the second ends of the pincer members spaced widely apart and a closed position with the second end of the pincer members lying closer together;

and a pair of opposing pickup blades each having a top end, a bottom end, and a contact edge extending along the bottom end, each one of said pick-up blades being fixed near the top end to the second end of a respective one of the pincer members for movement with said pincer member between the open position such that the contact edges of the blades are spaced apart from one another and the closed position such that the contact edges of the blades are in contact with one another, a handle grip mounted at the first end of the shaft;

and actuating means mounted on the handle grip such that actuating the actuating means causes the pincer mechanism to move the pick-up blades between the open position and the closed position;

and wherein the pick-up blades are mounted on the shaft such that with the shaft angled downwards the contact edges of the blades lie in a substantially horizontal plane.

The pick-up blades are preferably mounted at an angle of 45° to the shaft.

Alternatively the pick-up blades are mounted substantially perpendicular to the second end of the shaft; and the shaft includes a bend near the second end of the shaft spaced upwards from the pincer mechanism, said bend dividing the shaft into a first portion extending between the first end of the shaft and the bend and a second portion extending between the bend and the second end of the shaft, said second portion being angled towards the handle such that the contact edges of the pick-up blades lie substantially in the horizontal plane.

Alternatively the shaft may include a first section and a second section arranged such that the first and second sections are aligned axially and such that the first section can slide over the second section between an extended position and a retracted position.

The manual pick-up device in this arrangement may include biasing means arranged to bias the shaft in the extended position and securing means for securing the shaft from one of the extended or retracted positions.

Alternatively the shaft may include a first section, a second section, and folding means, said first and second sections being aligned axially to one another, and said folding means comprising a hinge member pivotally connecting adjacent ends of the first and second sections of the shaft thereof, such that the first and second sections can be moved between an aligned position with the first and second sections align axially to one another and a folded position with the first and second sections arranged to lie side by side.

The folding means may include a locking means for locking the first and second sections in the aligned position.

BRIEF DESCRIPTION OF THE DRAWINGS

In the accompanying drawings, which illustrate an exemplary embodiment of the present invention.

DETAILED DESCRIPTION

Figure 1:
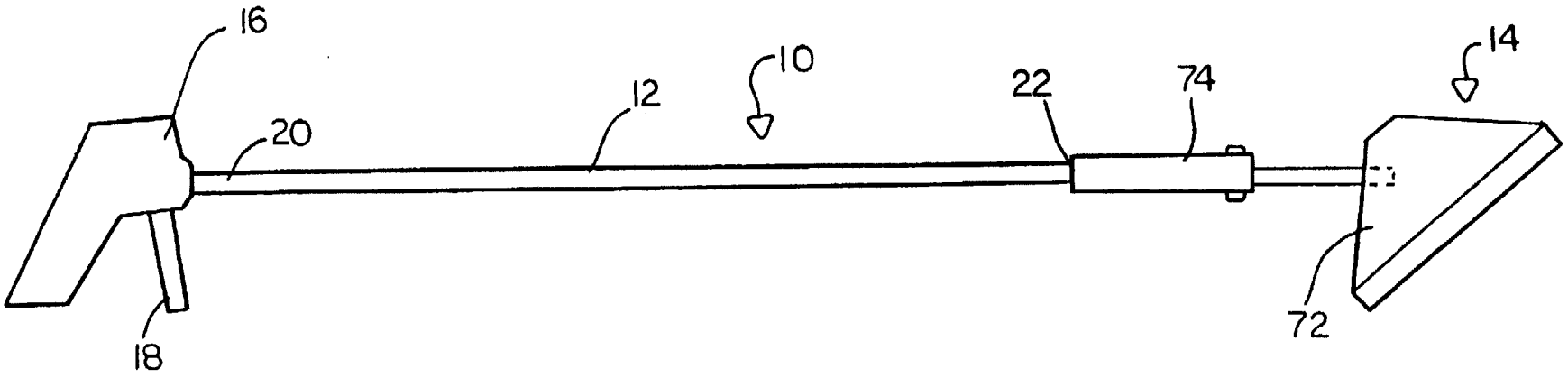
FIG. 1 is side view of the manual pick-up device.

Referring to FIG. 1 the manual pick-up device is shown generally at 10. The manual pick-up device 10 comprises a shaft 12, pick-up means 14, a handle 16, and actuating means 18 for causing the pick-up means 14 to pick up an item.

Figure 4:
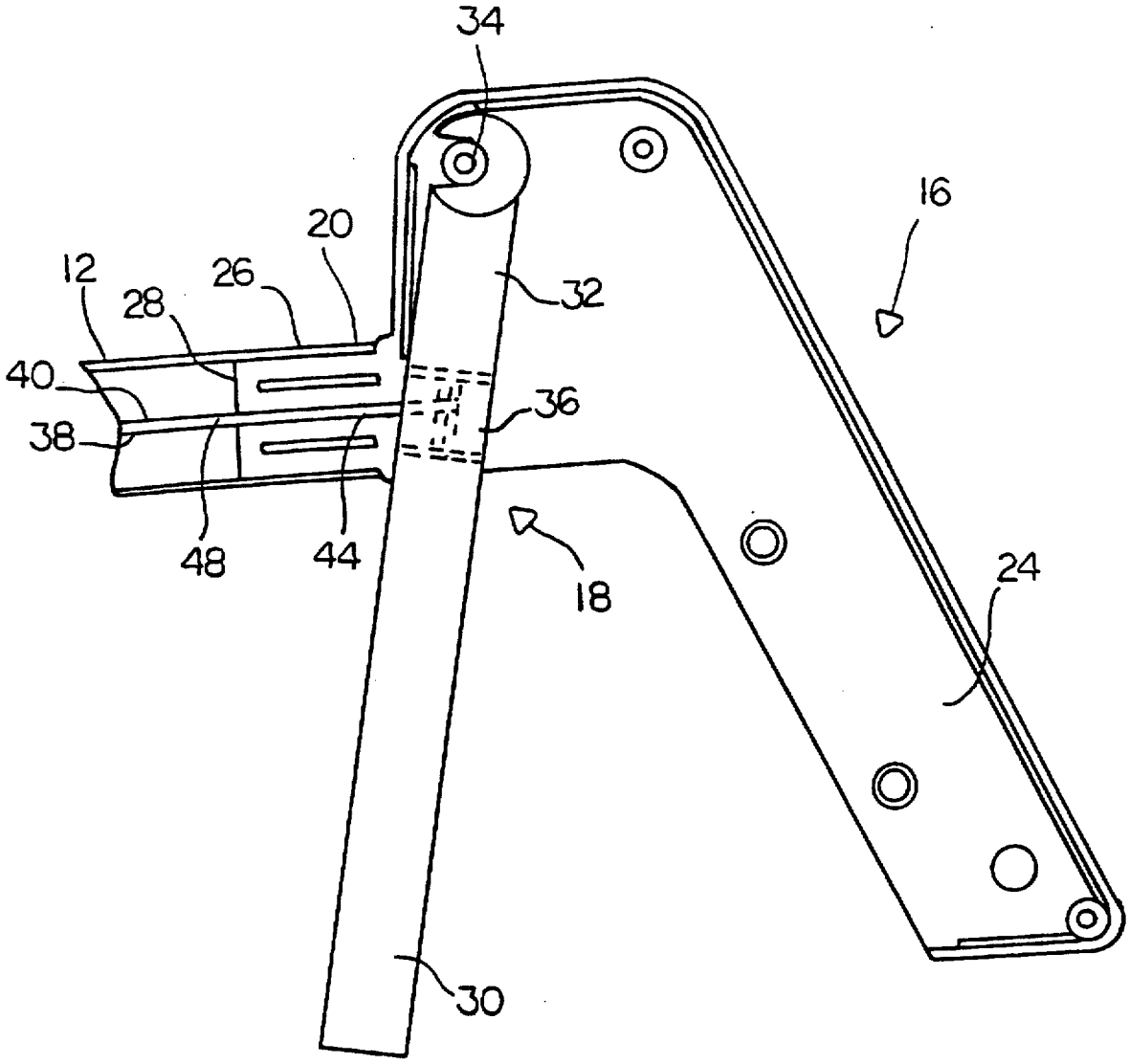
FIG. 4 is a side cross sectional view of the handle grip.

Referring to FIGS. 1 and 4 the shaft 12 comprises a hollow elongate tubular member which is rectangular in cross section and extends from the first end 20 to the second end 22.

The handle 16 comprises a split shell shaped to provide a hollow pistol-type grip 24. The handle 16 is mounted at the first end 20 of the shaft 12 and is arranged to extend substantially perpendicular to the shaft 12. A shaft engaging member 26 extends from the handle 16 outwards to an end 28. The shaft engaging member 26 is hollow like the handle 16 and engages within the first end 20 of the hollow shaft 12.

The actuating means 18 is provided by a lever 30 pivotally mounted at a first end 32 to a pin member 34 arranged within the handle 16. The lever member 30 includes an annular recess 36 at a position spaced from the first end 32 of the lever 30 and at a position such that it is aligned with the shaft engaging member 26 and shaft 12.

An elongate member 38 extends through the shaft 12 from the first end 20 to the second end 22 thereof. The elongate member 38 is usually a flexible member some examples of which are a cable, chain, or wire, and has a first end 40 and a second end 42. A first hook member 44 is fixed at the first end 40 of the elongate member 38 and a second hook member 46 is fixed at the second end 42.

The first hook member 44 is arranged to engage around the annular recess 36 of the lever member 30 and extends from the lever member 30 through the shaft connection member 26 to a second end 48 lying within the shaft 12. The second end 48 of the first hook member 44 is fixed to the first end 40 of the elongate member 38. The second hook member 46 is arranged at the second end 22 of the shaft 12 and extends from a first end 50 to a second end 52 and is fixed at its first end 50 to the second end 42 of the elongate member 38.

Biasing means 54 are arranged within the hollow shaft 12 and comprise a collar member 56 and a coil spring 58. The collar member 56 is arranged at a location within the shaft 12 spaced from the second end 22 of the shaft 12. An opening 62 extends through the collar member 56 and is arranged to receive the elongate member 38 and second hook member 46 therethrough. The coil spring 58 is arranged between the collar member 56 and the second end 22 of the shaft 12 and around the elongate member 38 and second hook member 46. The coil spring 58 has a first end 64 and a second end 66 and is arranged such that the first end 64 lies in contact with the collar member 56. A pivot lever actuating member 60 is arranged within the shaft 12 and has a first end 68 fixed to the second hook member 46 at a location adjacent the second end 66 of the coil spring 58 and extends from the first end 68 to a second end 70 lying outside of the shaft 12. The coil spring 58 biases the pivot lever actuating member 60 and second hook member 46 in a direction away from the handle grip 16 and towards the second end of the shaft 22.

Figure 5:
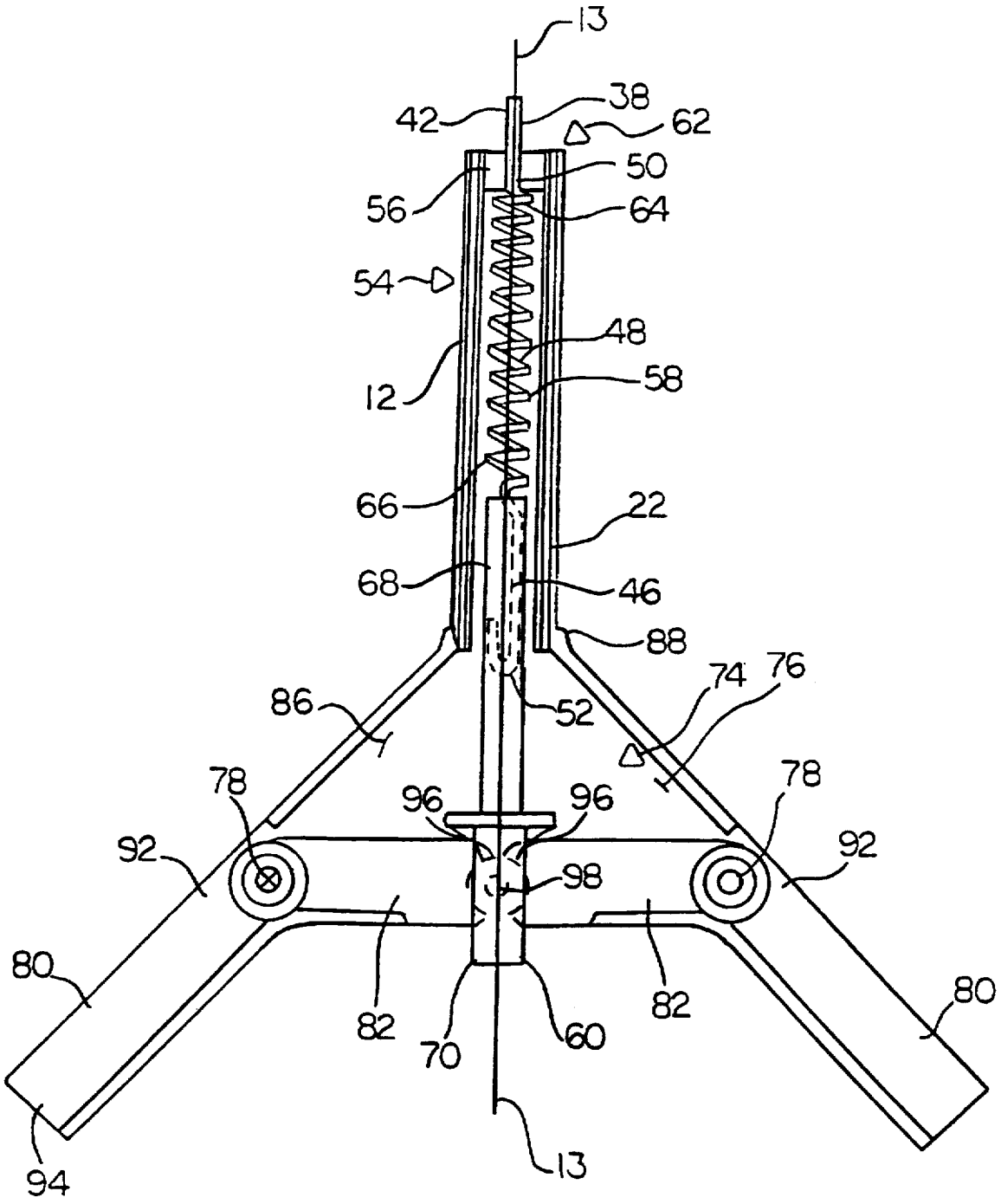
FIG. 5 is a top cross sectional view of the pincer mechanism.

Referring to FIGS. 1, 4, and 5 the pick-up means 14 comprise a pair of pick-up blades 72 mounted adjacent the second end 22 of the shaft 12 and a pincer mechanism 74 for opening and closing the pick-up blades 72.

The pincer mechanism 74 comprises an enclosure 76, pivot mounts 78, a pair of spaced apart pincer members 80, a pair of pivot lever members 82, and the pivot lever actuating member 60. The enclosure 76 is attached to the second end 22 of the shaft 12 and is substantially triangular. A pair of substantially triangular half shell members form the enclosure 76 when joined together. The triangular half shell members include substantially triangular plates 86 which are spaced apart from one another and are arranged to lie parallel to one another leaving a hollow between. A shaft engagement member 88 extends from one of the corners of the enclosure 76 and is arranged to engage within the second end 22 of the shaft 12. The shaft engagement member 88 is hollow to receive the second end 52 of the second hook member 48 and the pivot lever actuating member 60 therethrough.

The enclosure 76 encloses the pair of laterally spaced apart pivot mounts 78 which are positioned one at each of the two remaining corners of the enclosure 76. The pivot mounts 78 are provided by pin members arranged to extend between inner surfaces of the triangular plates 86.

Figure 2:
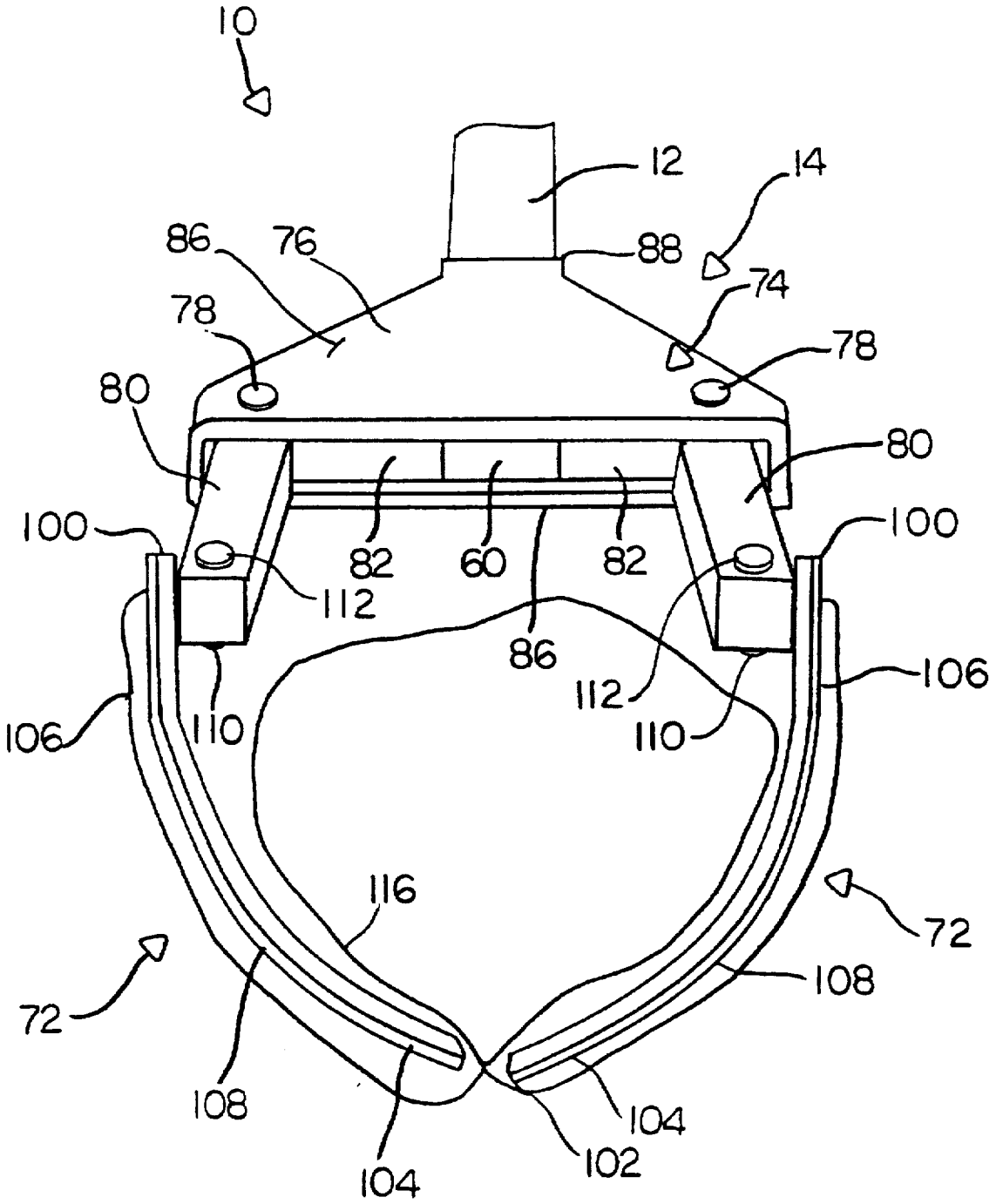
FIG. 2 is a front view of the manual pick-up device with the pick-up blades in the closed position.

Referring to FIGS. 2 and 5 each one of the pair of spaced apart pincer members 80 is mounted at a first end 92 on a respective one of the pivot mounts 78 and extends outwards from the pivot mount 78 to a second end 94. A respective one of the pivot lever members 82 extends from the first end 92 of each pincer member 80 inwards towards a longitudinal axis 13 of the shaft 12 to an end 96. Each pincer member 80 is arranged such that it lies coplanar to the shaft 12 and is free to pivot about the pivot mount 78 in a plane extending longitudinally through the shaft 12 and through the pivot mounts 78. The pincers 80 pivot between an open position with the second ends 94 of the pincer members 80 spaced widely apart and a closed position with the second ends 94 of the pincer members 80 spaced closer together.

The second end 70 of the pivot lever actuating member 60 is arranged to lie adjacent the pivot lever members 82 of the pincers 80. The lever actuating member 60 is connected to each of the pivot lever members 82 by connecting means 98 such that movement of the lever actuating member 60 in a direction away from the shaft 12 causes movement of the ends 96 of the pivot lever members 82 in the direction away from the shaft 12 thereby causing the pincer members 80 to move outwards away from the longitudinal axis 13 and into the open position. Movement of the lever actuating member 60 in a direction towards the shaft 12 causes the ends 96 of the lever members 82 to move in a direction towards the shaft 12 thereby causing the pincer members 80 to move inwards towards the longitudinal axis 13 and into the closed position. The biasing means 54 bias the second end 52 of the second hook 46 and the lever actuating member 60 in a direction away from the shaft 12 and thereby bias the pincers 80 towards the open position.

Figure 3:
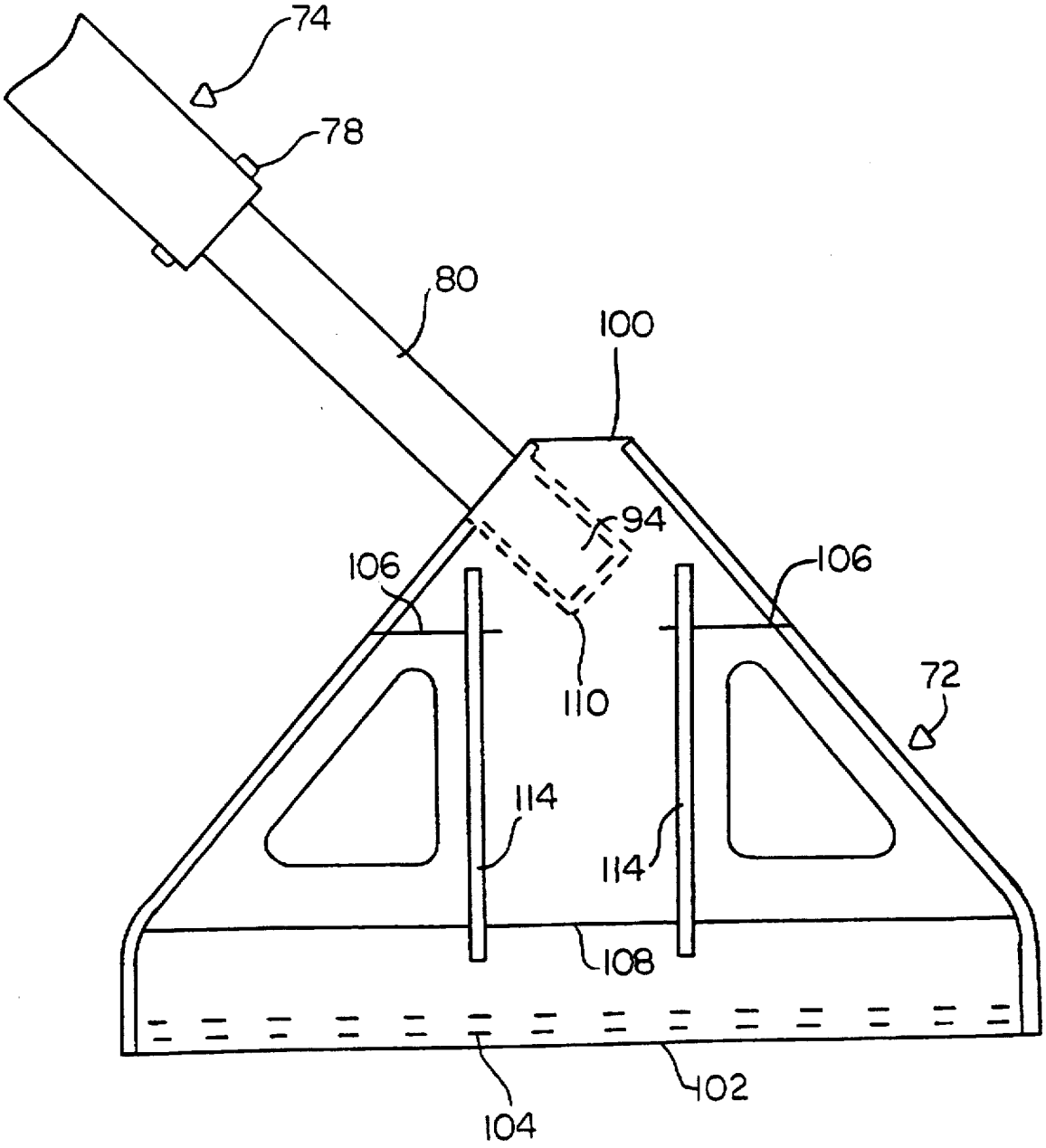
FIG. 3 is a side view of the pick-up blade.

Referring to FIGS. 2 and 3, fixed at the second end 94 of each pincer member 80 is one of the pick-up blades 72. Each pick-up blade 72 extends from a top end 100 to a contact edge 102 at a bottom end 104 thereof. The pick-up blades 72 are curved inwards from the top end 100 to the bottom end 104 with the curve being produced by first and second bends. The first bend 106 is spaced downwards from the top end 100 and the second bend 108 is spaced downwards from the first bend 106. Each of the pick-up blades 72 is fixed near the top end 100 to the second end 94 of a respective one of the pincers 80. Each pick-up blade 72 is fixed by a flange 110 mounted on the pick-up blade 72 and a fastener 112 which fixes a respective pincer 80 to the flange 110. The pick-up blades 72 are mounted on the pincers 80 at an angle such that the contact edge 102 lies at approximately 45° to the shaft 12. This enables the shaft to be angled downwards while keeping the contact edges 102 of the pick-up blades 72 in a substantially horizontal plane.

Movement of the pincer members 80 between the open position and the closed position causes the pick-up blades 72 to move from an open position with the contact edges 102 of the blades 72 spaced apart from one another to a closed position with the contact edges 102 of the blades 72 in contact with one another.

The pick-up blades 72 also include a pair of reinforcing ribs 114 extending along the pick-up blades 72 from a position spaced downwards from the top of the blade 100 to a position spaced upwards from the bottom of the blade 104.

A bag 116 may be placed over the pick-up blades 72 such that when the pick-up blades 72 are closed, the bag envelopes the item being picked up. The bag 116 thus provides a means for storing the item so that the individual does not have to handle the item directly.

Figure 6:
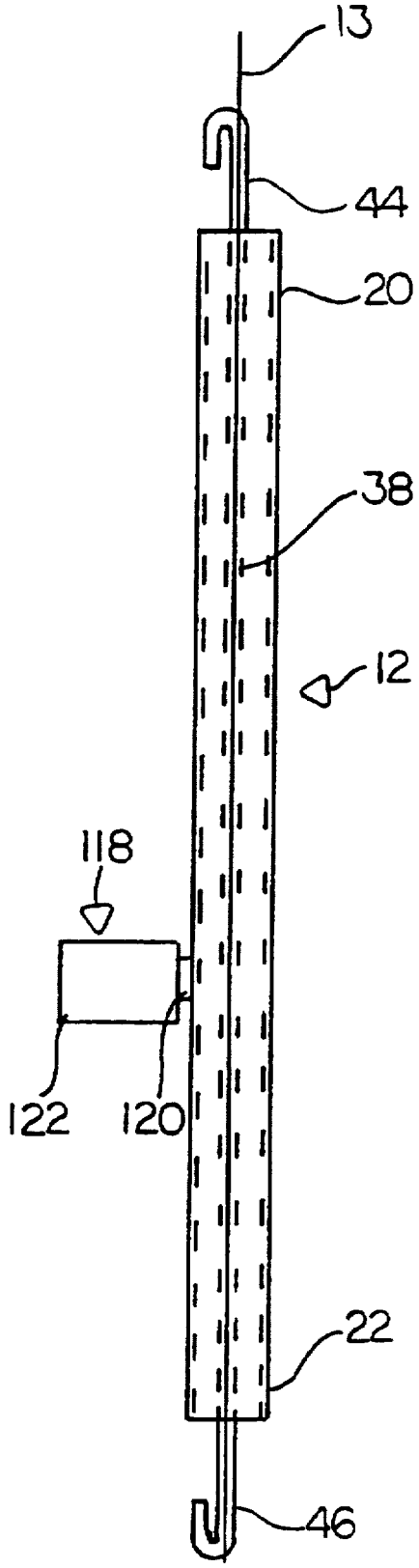
FIG. 6 is a side view of the shaft showing the flashlight mount mounted thereon.
Figure 7:
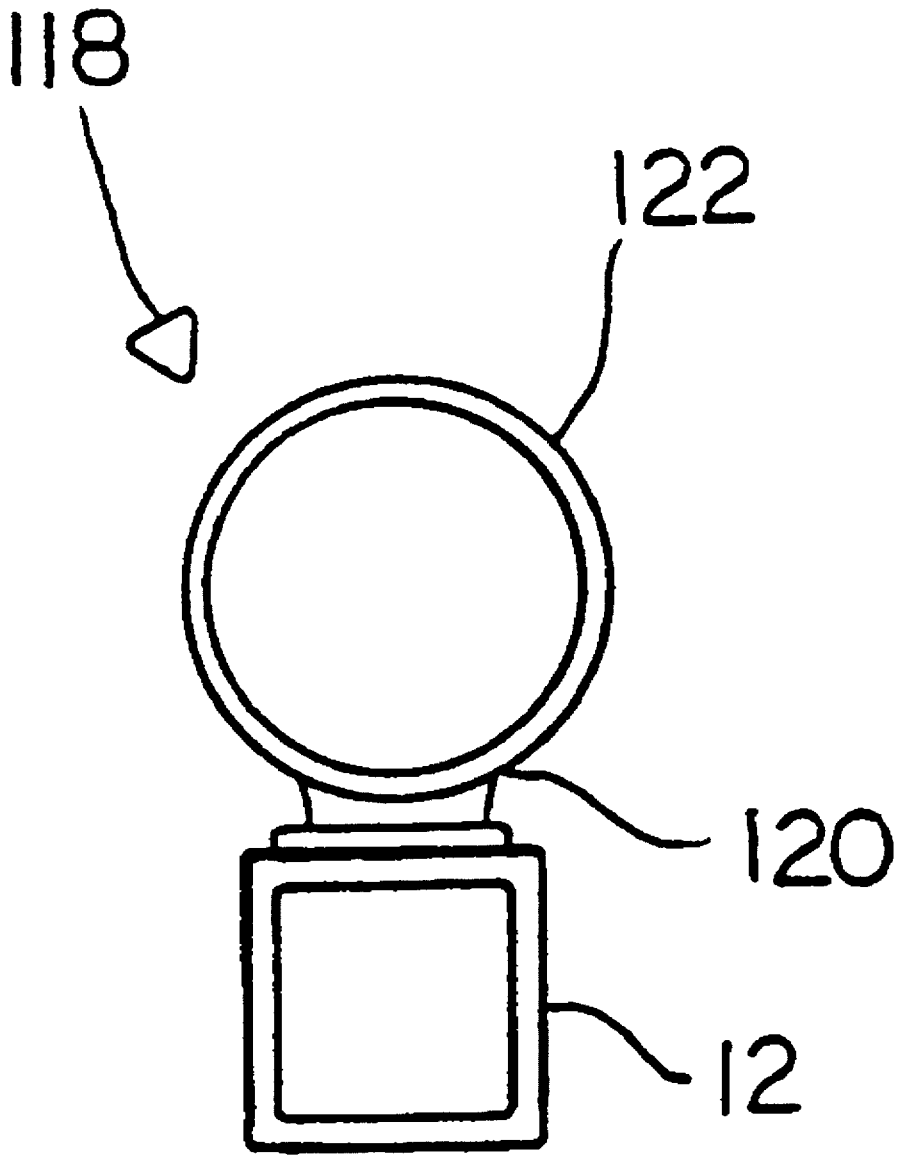
FIG. 7 is a front view of the flashlight mount.

Referring to FIGS. 6 and 7 the manual pick-up device 10 may include a flashlight mount 118 for removably mounting on the shaft 12. The flashlight mount comprises a base mount 120 which is fixed to an outer surface of the shaft 12 by removable and reengageable fixing means and a hollow cylindrical member 122 fixed to the base mount 120 and arranged to lie parallel to the shaft 12. The hollow cylindrical member 122 is sized to receive a flashlight therein.

In use the manual pick-up device 10 is held in one hand by an individual using the device with the shaft 12 angled forwards and downwards. The pick-up blades 72 are moved to a position over an item to be picked up with the pick-up blades 72 in the open position and the contact edges 102 of the blades 72 positioned on either side of and adjacent the bottom of the item. The actuating lever 30 is then moved inwards towards the handle grip 24 causing movement of the first hook 44 in a direction towards the handle grip 24 which moves the elongate member 38 and the second hook 46 towards the shaft 12. This moves the lever actuating member 60 in a direction towards the shaft 12 closing the pincers 80 and the pick-up blades 72, and picking up the item.

In alternative arrangements, the pick-up blades 72 may be mounted at any appropriate angle such that the contact edges 102 are in a useful position when the shaft 12 is angled downwards.

Figure 8:
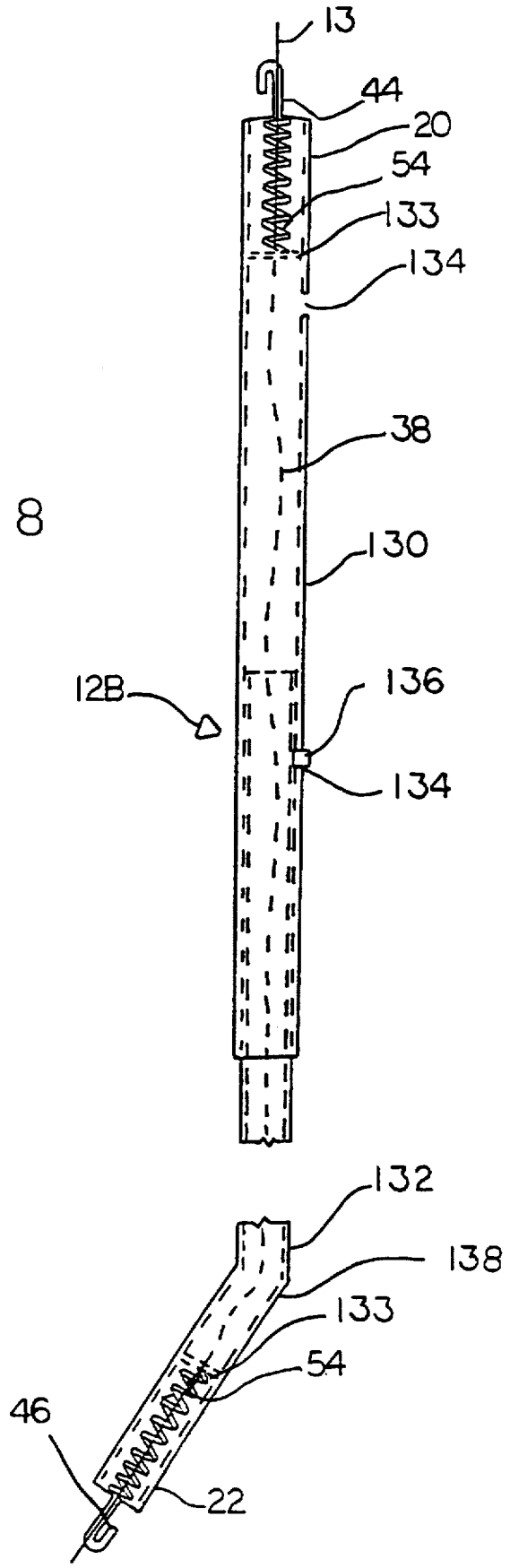
FIG. 8 is side view of the telescopic shaft.

Referring to FIG. 8 in a second alternative embodiment the manual pick-up device 10 includes a telescoping shaft 12B which comprises first and second sections 130 and 132 which are aligned axially and are sized and arranged such that the first section 130 can slide over the second section 132 between an extended position and a retracted position. The elongate member 38 extends between a first hook 44 and a second hook 46 as in the embodiment described above; however, biasing means 54 are arranged at each end of the shaft 12 for biasing the shaft 12B into the retracted position.

The telescoping shaft 12B includes securing means for selectively securing the shaft 12 in one of the extended or retracted positions. The securing means comprise a plurality of selectable openings 134 spaced longitudinally along the first section 130 of the shaft 12B and a sprung button retainer 136 mounted on the second section 132 of the shaft 12B which is arranged to slide within the first section 130 of the shaft 12B and to selectively engage any one of the plurality of spaced apart openings 134. The securing means are operated by depressing the sprung button 136 and sliding the first section 130 and second section 132 relative to one another into one of the retracted or extended positions such that the sprung button 136 aligns with a desired one of the holes 134 at which point the button will extend through the hole 134 securing the first shaft section 130 and the second shaft section 132 relative to one another.

The biasing means 54 usually comprise a coil spring arranged within the first section 130 and held in place at a first end on the first section 130 by a collar 133. The biasing means 54 extend from the collar 133 to a second end and are arranged to engage the second section 132 adjacent the bottom end 22 thereof.

In a further alternative embodiment the telescoping shaft 12B may include an angled portion 138 extending laterally of the longitudinal axis 13 of the shaft 12B at a position spaced from the bottom end 22 thereof.

Figure 9:
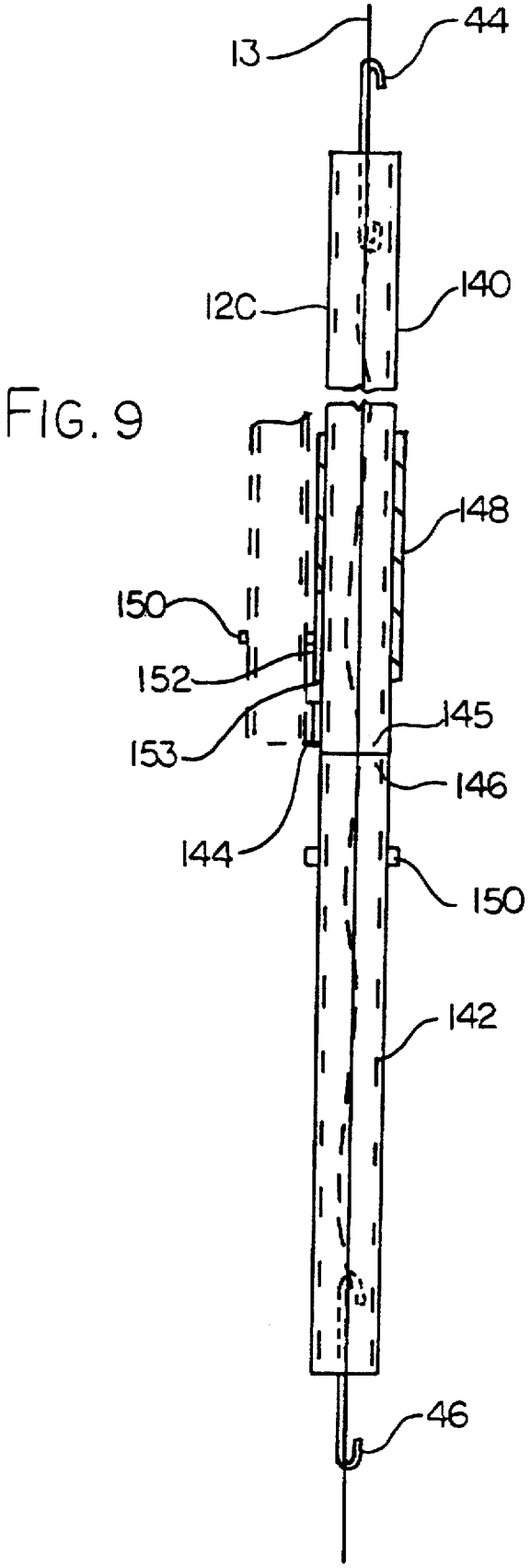
FIG. 9 is a side view of the foldable shaft.

Referring to FIG. 9 another alternative embodiment of the manual pick-up device 10 includes a folding shaft 12C having a first section 140 and a second section 142 arranged such that the first and second sections 140 and 142 are arranged axially to one another, and folding means 144 comprising a hinge member mounted on the shaft 12C and pivotally connecting adjacent ends 145 and 146 of the first and second sections 140 and 142 thereof. The first and second sections 140 and 142 can be moved between an aligned position with the first and second sections 140 and 142 aligned axially to one another and a folded position with the first and second sections 140 and 142 arranged to lie side by side.

The folding means 144 include a locking means for locking the first and second sections 140 and 142 in the aligned position. The locking means comprise a tubular member 148 which is slidably arranged on the first member 140 and a stop 150 arranged on the second member 142 at a position spaced downwards from the hinged end 146 thereof. The tubular member 148 may be repositioned along the shaft 12C from a position wholly on the first member 140 thereby allowing the shaft to fold to a second position extending over the ends 145,146 of the first and second sections 140 and 142 with the tubular member in contact with the stop 150 thereby preventing the shaft from folding. The tubular member 148 includes a slot 152 extending longitudinally along the tubular member 148 from a bottom end 153 thereof. The slot 152 is sized and arranged to receive the hinge member 144 therein when the tubular member 148 is in position to prevent folding of the shaft.

Figure 10:
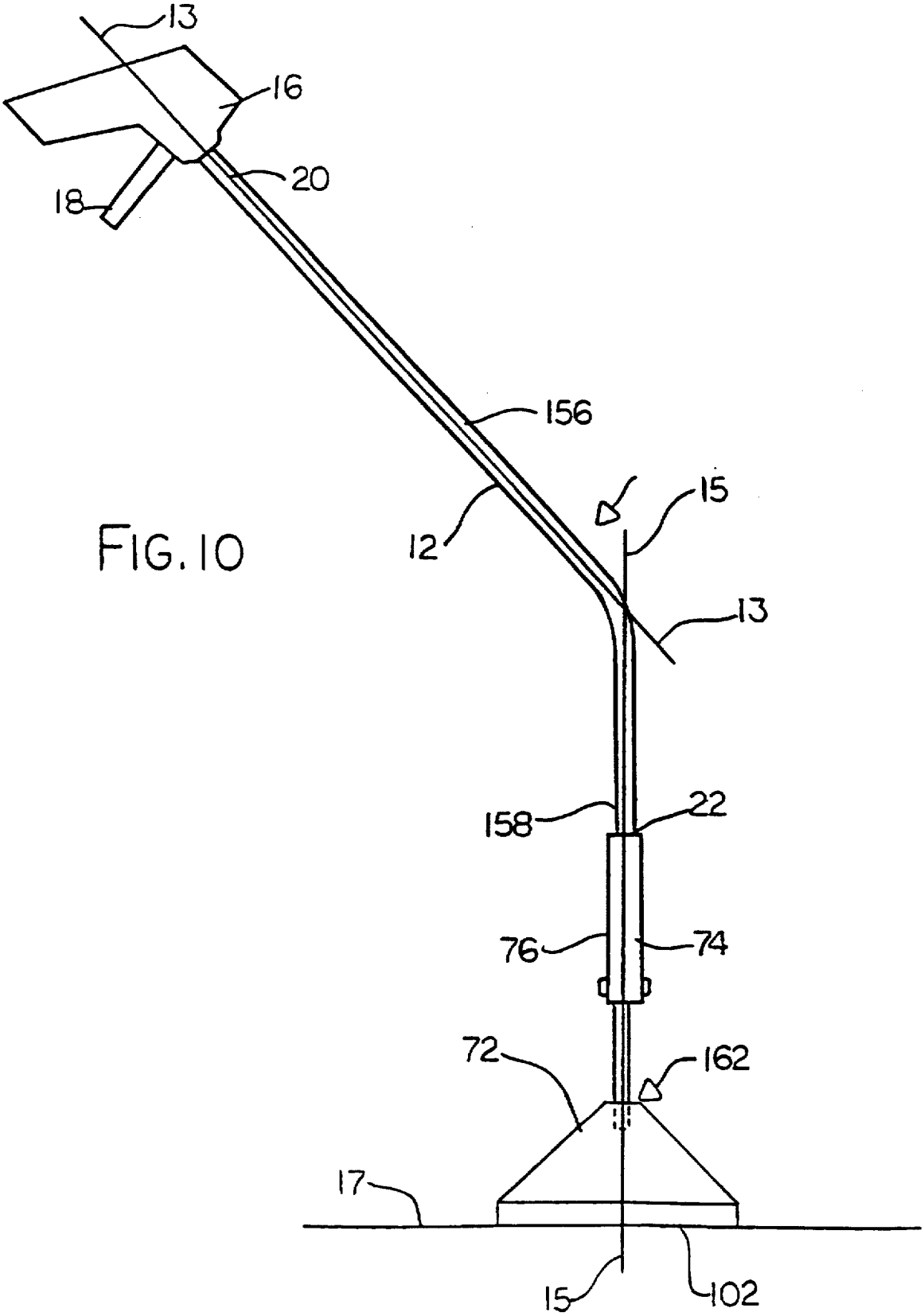
FIG. 10 is side view of an alternative arrangement of the manual pick-up device.
Figure 11:
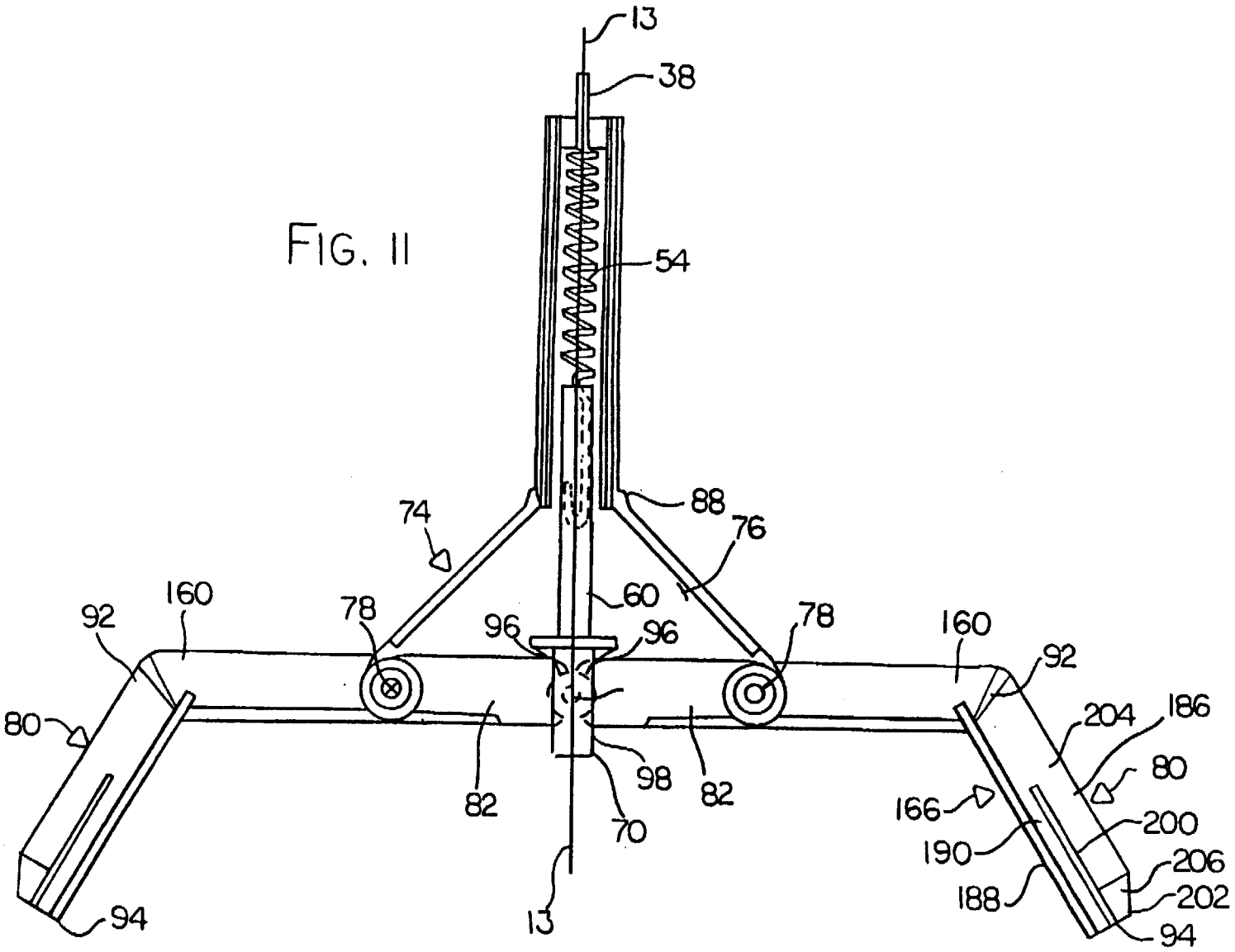
FIG. 11 is a cross sectional view of an alternative arrangement of the pincer mechanism.
Figure 12:
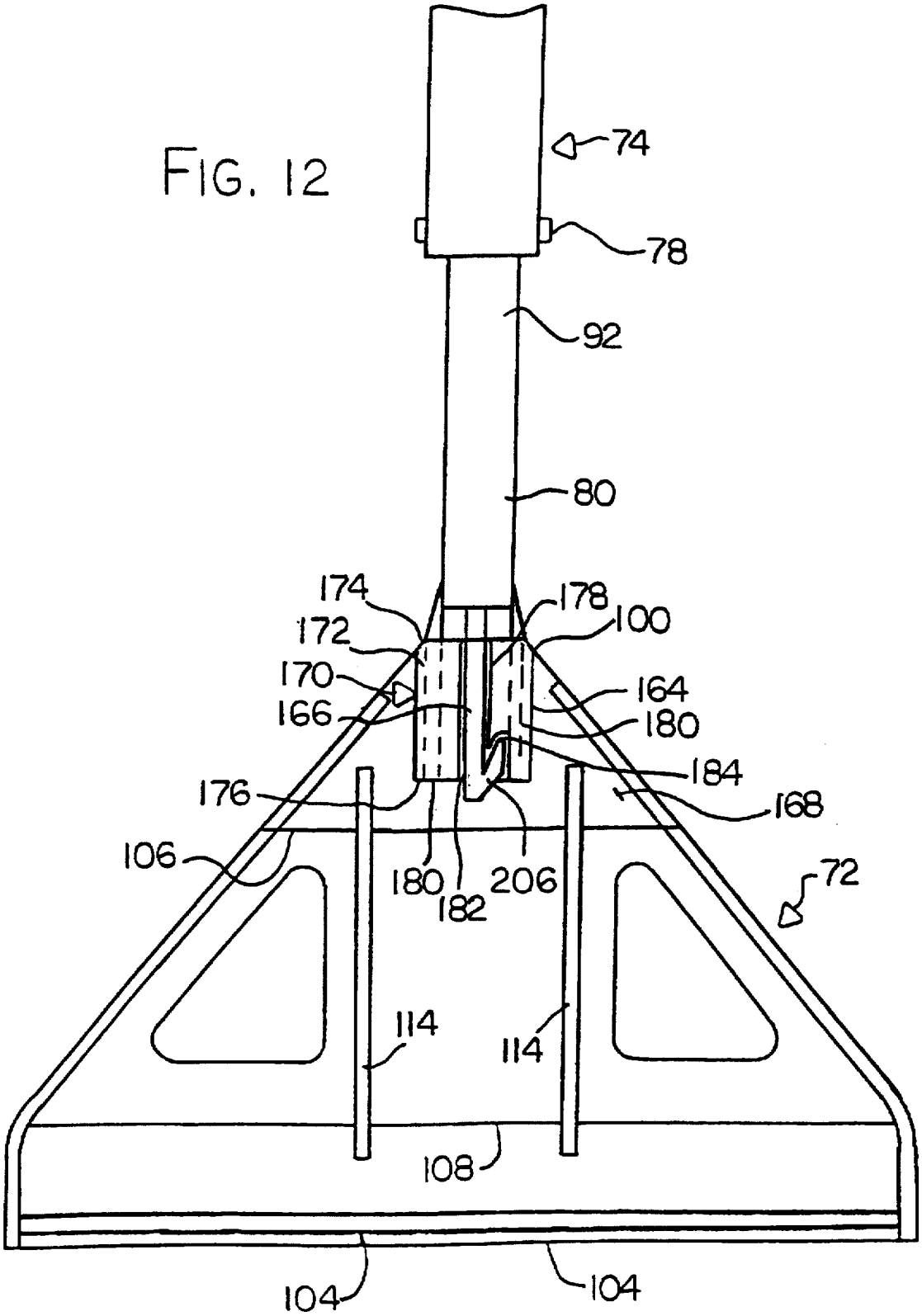
FIG. 12 is a side view of an alternative arrangement of the pickup blade.

Another alternative embodiment of the manual pick-up device 10 is shown in FIGS. 10, 11, and 12. The shaft 12 includes a bend 154 spaced upwards from the enclosure 76 and arranged near the second end 22 of the shaft 12. The bend 154 divides the shaft 12 into a first portion 156 extending between the first end 20 and the bend 154 and a second portion 158 extending between the bend 154 and the second end 22. The second portion 158 of the shaft 12 has a center line 15 extending longitudinally therethrough and lies at an angle to the first portion 156. The pick-up blades 72 are mounted on the shaft 12 at the top 100 such that the contact edges 102 lie substantially perpendicular to the second portion 158 of the shaft 12. The second portion 158 is bent towards the handle 16 such that the bend 154 provides the desired angle between the contact edges 102 and the ground 17. The bend 154 is also arranged such that with the contact edges 102 in contact with the ground the device 10 is balanced so that it will remain standing upright if released by the user.

The pincer mechanism 74 has been modified to improve the ability of the blades 72 to pick up items and to provide lateral stability when the device 10 is standing in an upright position. The pivot lever members 82 in this embodiment each extend laterally outwards and past a respective pivot connection 78 to a second end 160. The first end 92 of each pincer member 80 is fixed to the second end 160 of a respective pivot lever member 82 such that the pincer member 80 extends from the second end 160 of the pivot lever member 82 in a direction away from the second end 22 of the shaft 12 and laterally outwards at a slight angle. This spaces the blades 72 further apart providing a more stable base when supporting the device 10 in a standing position and improves the ability of the contact edges 102 to get under the item to be picked up.

To allow for easier cleaning of the blades 72 and storage of the device, the blades 72 include a removable and reengagable connection means 162 for connecting the top 100 of each of the blades 72 to a respective one of the pincers 80. Referring to FIGS. 11 and 12 each removable and reengagable connection means 162 comprises a receptacle 164 and a connection member 166. The receptacle 164 is fixed to an outer face 168 of the blade 72 at the top 100 of the blade 72 and is aligned with a respective one of the pincers 80. The receptacle 164 comprises a rectangular member 170 having an outer face 172, a first end 174 lying adjacent the shaft 12, and a second end 176 opposite the first end 174. A slot 178 has a wide portion 180 lying adjacent the outer face 168 of the blade 72 and a narrow portion 182 extending to the outer face 172 of the receptacle 164. A notch 184 is arranged in the second end 176 of the receptacle 164 adjacent the slot 178.

The connection member 166 comprises an outer portion 186 of each of the pincers 80 and a flange 188 extending perpendicularly from an inner portion 190 of each of the pincers 80. Each outer portion 186 of the pincer 80 is partially severed from the pincer 80 by a slot 200 extending along the pincer 80 from the second end 94 of the pincer 80 towards the first end 92 of the pincer 80. This provides the connection member 166 with a free second end 202 lying adjacent the second end 94 of the pincer 80 and a first end 204 fixed to the pincer 80 near the first end 92 thereof. A projection 206 is arranged at the second end 202 of the connection member 166 for cooperation with the notch 184 in the receptacle 164. The projection 206 and notch 184 secure the blade 72 vertically from below while the top 100 of the blade 72 is in contact with the pivot lever member 82 which secures the blade 72 vertically from above.

The outer portion 186 is sized to slidably engage within the narrow portion 182 of the slot 178 such that the connection member 166 may be moved between the sides of the slot 178 such that the first end 202 can be moved between a first position adjacent to the notch 184 with the projection 206 engaged within the notch 184 and a second position spaced from the notch 184 with the projection 206 disengaged from the notch 184.

The flange 188 is sized to engage within the wide portion 180 of the slot 178. This secures the blade 72 laterally on the pincer 80.

While a number of embodiments of the present invention have been described in the foregoing, it is to be understood that other embodiments are possible within the scope of the invention. The invention is to be considered limited solely by the scope of the appended claims.

I claim:

1. A manual pick-up device comprising:

a shaft having a first end, a second end and a bend near the second end of the shaft dividing the shaft into a first portion extending between the first end of the shaft and the bend and a second portion extending between the bend and the second end of the shaft;

a pair of opposing pickup blades mounted on the second end of the shaft wherein the pickup blades include a contact edge along a bottom side such that with the first portion of the shaft angled downwards the contact edges of the blades lie in a substantially horizontal plane;

a pincer mechanism mounting the pickup blades to the second end of the shaft for displacement of the blades between an open position wherein the contact edges of the blades lie spaced apart from one another and a closed position wherein the contact edges of the blades lie in contact with one another;

a handle grip mounted at the first end of the shaft;

and actuating means mounted on the handle grip such that actuating the actuating means causes the pincer mechanism to move the pickup blades between the open position and the closed position.

2. A manual pick-up device in accordance with claim 1 wherein the pick-up blades curve towards one another from a top end thereof downwards and inwards to a contact edge.

3. A manual pick-up device in accordance with claim 1 wherein the pick-up blades are mounted at an angle to the first portion of the shaft.

4. A manual pick-up device in accordance with claim 3 wherein the pick-up blades are mounted such that the contact edges of the pick-up blades lie at an angle of 45 degrees to the first portion of the shaft.

5. A manual pick-up device in accordance with claim 1 wherein the pincer mechanism lies in a plane substantially perpendicular to the handle grip.

6. A manual pick-up device in accordance with claim 1 wherein the pick-up blades are mounted substantially perpendicular to the second end of the shaft and wherein the second portion of the shaft is angled towards the handle grip such that the contact edges of the pick-up blades lie substantially in the horizontal plane.

7. A manual pick-up device in accordance with claim 1 wherein the device is weight balanced such that the device will remain standing upright when the contact edges are in contact with a supporting surface.

8. A manual pick-up device in accordance with claim 1 including readily removable and reengagable connection means for connecting a top of each of the blades to a respective pincer member of the pincer mechanism.

9. A manual pick-up device in accordance with claim 8 wherein each of the removable and reengagable connection means comprises:

a receptacle fixed to the blade adjacent the top thereof and aligned with the pincer member;

a notch arranged in a second end of the receptacle;

and a connection member arranged to slidably engage within the receptacle having a projection extending outward therefrom, said projection being arranged for cooperation with the notch in the receptacle and for removably engaging within the notch thereby securing the connection member within the receptacle.

10. A manual pick-up device comprising:

a shaft having a first end and a second end;

a pair of pivot mounts mounted laterally spaced apart on the second end of the shaft;

a lever actuating member aligned axially with the shaft and extending in a direction away from the shaft towards the pivot mounts;

a pair of lever members each being connected at a first end to the lever actuating member and extending laterally outwards past a respective one of the pivot mounts to a second end wherein each of the lever members is mounted to the respective pivot mount for pivotal movement about the pivot mount;

a pair of pincer members each being connected to the second end of a respective one of the lever members such that the pincer members extend in a direction away from the shaft and laterally outwards at a slight angle; and a pair of blades each being mounted on an outward end of a respective one of the pincer members such that the blades are displaced in response to displacement of the lever actuating member between an open position wherein the blades lie spaced apart from one another and a closed position wherein the blades lie in contact with one another.

11. A manual pick-up device in accordance with claim 10 wherein the pick-up blades curve towards one another from a top end thereof downwards and inwards to a contact edge thereof.

12. A manual pick-up device in accordance with claim 11 wherein the pick-up blades are mounted such that the contact edges of the pick-up blades lie at an angle of 45 degrees to the shaft.

13. A manual pick-up device in accordance with claim 10 wherein the pick-up blades are mounted at an angle to the shaft.

14. A manual pick-up device in accordance with claim 10 wherein there is provided a handle grip mounted on the first end of the shaft wherein the handle grip lies in a plane substantially perpendicular to the pincer members.

15. A manual pick-up device in accordance with claim 10 wherein the pick-up blades are mounted substantially perpendicular to the second end of the shaft and wherein the shaft includes a bend near the second end of the shaft spaced upwards from the pincer mechanism, said bend dividing the shaft into a first portion extending between the first end of the shaft and the bend and a second portion extending between the bend and the second end of the shaft, said second portion of the shaft being angled towards the handle girp such that the contact edges of the pickup blades lie substantially in the horizontal plane.

16. A manual pick-up device in accordance with claim 15 wherein the device is weight balanced such that the device will remain standing upright when the blades are in contact with a supporting surface.

17. A manual pick-up device in accordance with claim 10 including readily removable and reengagable connection means for connecting the blades to the respective pincer members.

18. A manual pick-up device in accordance with claim 17 wherein the removable and reengagable connection means comprise:

a receptacle fixed to the blade adjacent to a top end and aligned with the respective pincer member;

a notch arranged in a bottom end of the receptacle;

and a connection member arranged to slidably engage within the receptacle having a projection extending outward therefrom, said projection being arranged for cooperation with the notch in the receptacle and for removably engaging within the notch thereby securing the connection member within the receptacle.

* * * * *